US005657850A

United States Patent [19]

Suzuki et al.

[11] Patent Number: 5,657,850

[45] Date of Patent: Aug. 19, 1997

[54] APPARATUS FOR RECEIVING ROD MEMBERS

[75] Inventors: Minoru Suzuki; Takehiro Suzuki, both of Tokyo, Japan

[73] Assignee: Japan Tobacco, Inc., Tokyo, Japan

[21] Appl. No.: 505,004

[22] Filed: Jul. 21, 1995

[30] Foreign Application Priority Data

Jul. 22, 1994 [JP] Japan ..... 6-170765

[51] Int. Cl.[6] ..... B65G 47/26

[52] U.S. Cl. ..... 198/438; 198/441; 198/457; 198/803.5

[58] Field of Search ..... 198/471.1, 440, 198/441, 445, 450, 478.1, 480.1, 457, 438, 803.5

[56] References Cited

U.S. PATENT DOCUMENTS

| | | | |
|---|---|---|---|
| 3,602,357 | 8/1971 | Schubert | 198/441 X |
| 3,664,891 | 5/1972 | Schubert et al. . | |
| 3,667,587 | 6/1972 | Preston . | |
| 3,825,105 | 7/1974 | Cristiani | 198/471.1 |
| 4,508,207 | 4/1985 | Oberdorf | 198/471.1 |
| 4,562,916 | 1/1986 | Filter | 198/450 X |
| 4,840,266 | 6/1989 | Gheradi | 198/471.1 |

FOREIGN PATENT DOCUMENTS

| | | |
|---|---|---|
| 2196955 | 3/1974 | France . |
| 2443764 | 4/1976 | Germany . |
| 2640566 | 3/1978 | Germany . |
| 1409814 | 10/1975 | United Kingdom . |

*Primary Examiner*—D. Glenn Yuan

*Attorney, Agent, or Firm*—Birch, Stewart, Kolasch & Birch, LLP

[57] ABSTRACT

A receiving apparatus for cigarettes having a catcher drum rotatable in one direction, a large number of receiving grooves formed in the outer peripheral surface of the catcher drum, each receiving groove being tunnel-shaped and permitting a received double cigarette to advance, a stopper member formed in each receiving groove and having a stopper surface, a plurality of suction holes formed in the bottom of each receiving groove for supplying a suction pressure to the receiving groove, and a hole permitting the atmosphere or suction pressure to be introduced into the receiving groove from the stopper surface of the stopper member, where the suction pressure supplied from the suction holes and the atmospheric pressure introduced from the stopper surface cooperatively cause the double cigarette advancing in the receiving groove to be stopped at a position short of the stopper member.

20 Claims, 8 Drawing Sheets

APPARATUS FOR RECEIVING ROD MEMBERS

BACKGROUND OF THE INVENTION

1. Field of the Invention

This invention relates to an apparatus for receiving double cigarettes or single cigarettes, as rod members, manufactured by and delivered from a cigarette manufacturing machine.

2. Description of the Related Art

A manufacturing system for filter cigarettes generally comprises a cigarette manufacturing machine for producing double cigarettes or single cigarettes, and an attachment machine, or a so-called filter attachment, for attaching filters to cigarettes.

Cigarettes produced by the cigarette manufacturing machine are intermittently delivered on a predetermined delivery line toward the filter attachment. The filter attachment has an apparatus incorporated therein for receiving the cigarettes on the delivery line, and this receiving apparatus includes a catcher drum.

The catcher drum has a drum shell rotated in one direction, and a large number of receiving grooves are formed in the outer peripheral surface of the drum shell. The receiving grooves are arranged at regular intervals in the circumferential direction of the drum shell. The catcher drum further includes a drum cover surrounding the drum shell, and the drum cover serves to make each receiving groove of the drum shell tunnel-shaped.

When a receiving groove of the drum shell is positioned in alignment with the aforementioned delivery line with rotation of the drum shell, a cigarette on the delivery line enters the receiving groove. Thus, the cigarette is received in the receiving groove and then advances within the groove.

A stopper member is arranged in each receiving groove, and stops the movement of the cigarette while at the same time positioning the cigarette in the receiving groove.

As the drum shell rotates thereafter, the cigarette in each receiving groove is transported toward a grooved drum which adjoins the catcher drum, and is transferred to the grooved drum.

In recent years, there is a tendency for the operational speed of filter cigarette manufacturing systems to increase, and thus the speed of delivery of cigarettes to the filter attachment, that is, to the receiving apparatus, is increasing.

Since the speed of entry of cigarettes into the receiving grooves of the drum shell also increases, it is difficult to optimally brake the cigarettes within the receiving grooves. In some cases, the cigarettes received in the receiving grooves violently collide against the stopper members. Such collision can damage cigarette ends or cause cigarette ends to rise from the bottoms of the receiving grooves, hindering stable holding of the cigarettes within the receiving grooves.

If cigarettes are damaged, the quality thereof lowers. Also, unstable holding of cigarettes within the receiving grooves makes it impossible for the cigarettes to reliably transfer from the catcher drum to the grooved drum adjacent thereto.

SUMMARY OF THE INVENTION

It is an object of the present invention to provide a receiving apparatus which is capable of stable and accurate reception of rod members without damaging the rod members even in the case where the speed of reception of the rod members is increased.

The above object is achieved by a receiving apparatus according to this invention which comprises: a catcher drum arranged at a terminal end of a delivery line for rod members and rotatable in one direction, the catcher drum including receiving grooves arranged on an outer peripheral surface thereof at regular intervals in a circumferential direction thereof, the receiving grooves each having a bottom extending parallel with the delivery line and one end opening in an end face of the catcher drum, the receiving grooves successively reaching a receiving position located in alignment with the delivery line as the catcher drum rotates, and a rod member at a leading position on the delivery line entering one of the receiving grooves from the one end thereof and advancing within the receiving groove; covering means for the catcher drum, the covering means having a cover which covers part of the outer peripheral surface of the catcher drum along the circumferential direction of the catcher drum, the receiving position being contained in the cover, the cover making each of the receiving grooves tunnel-shaped when the receiving groove passes the cover as the catcher drum rotates; a stopper member arranged in each of the receiving grooves; braking means for stopping the rod member advancing in the tunnel-shaped receiving groove at a position short of the stopper member, the braking means including suction means for attracting the rod member to the bottom of the receiving groove; assisting means for assisting a braking force exerted by the suction means on the rod member; and actuating means for moving the rod member stopped in the tunnel-shaped receiving groove to the stopper member.

In the above receiving apparatus, a rod member which has entered a receiving groove of the catcher drum and is advancing in the groove stops at a position short of the stopper member, because it is acted upon by the braking force or the suction pressure from the suction means and also by an assisting force from the assisting means. The rod member thus stopped is thereafter again moved by the actuating means to the stopper member. Thus, even if a rod member enters a receiving groove of the catcher drum at high speed, it is not immediately brought to the stopper member. Accordingly, the rod member can be prevented from violently colliding with the stopper member, thus preventing damage to the rod member, as well as unstable holding of the rod member in the receiving groove.

The suction means can be implemented by a plurality of suction holes formed in each receiving groove, and the assisting means can be implemented by introducing means for introducing the atmosphere into each receiving groove. In this case, the atmosphere introduced into the receiving groove, that is, the atmospheric pressure, serves as air resistance to the rod member advancing in the receiving groove, and causes the rod member to be reliably stopped at a position short of the stopper member, in cooperation with the aforementioned suction pressure. In this regard, assuming that the rod member is stopped only by the suction pressure from the suction holes, if the speed of entry of the rod member to the receiving groove increases and thus the suction pressure from the suction holes is correspondingly increased, a vacuum may be formed in the receiving groove. If this occurs, the rod member is subjected to the attracting force resulting from the vacuum and violently collides with the stopper member. However, the apparatus according to this invention is free from the drawback because the atmosphere is introduced into the receiving groove.

The atmosphere introducing means can be easily implemented by an atmosphere hole formed in the cover and an atmosphere introducing channel for connecting the atmosphere hole and the receiving groove.

Preferably, the receiving apparatus includes pressure regulating means for adjusting the suction pressure from the suction holes, and adjusting means for adjusting the opening area of the atmosphere hole.

Further, the actuating means can be implemented by second suction means for attracting the rod member, and in this case, the first and second suction means can share a common negative pressure source.

The second suction means can be implemented by a negative pressure introducing channel for supplying the suction pressure to the receiving groove. Preferably, the negative pressure introducing channel and the atmosphere introducing channel share a common part extending through the stopper member. In this case, the arrangement of the negative pressure introducing channel and atmosphere introducing channel is simplified.

The receiving apparatus can further include second supply means for supplying the suction pressure to the suction holes when the rod member is in close contact with the stopper member of the receiving groove. In this case, the rod member positioned by the stopper member can be held with stability.

The adjusting means can be implemented by a slider mounted on the outer peripheral surface of the cover, and the position of the slider determines the opening of the atmosphere hole.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
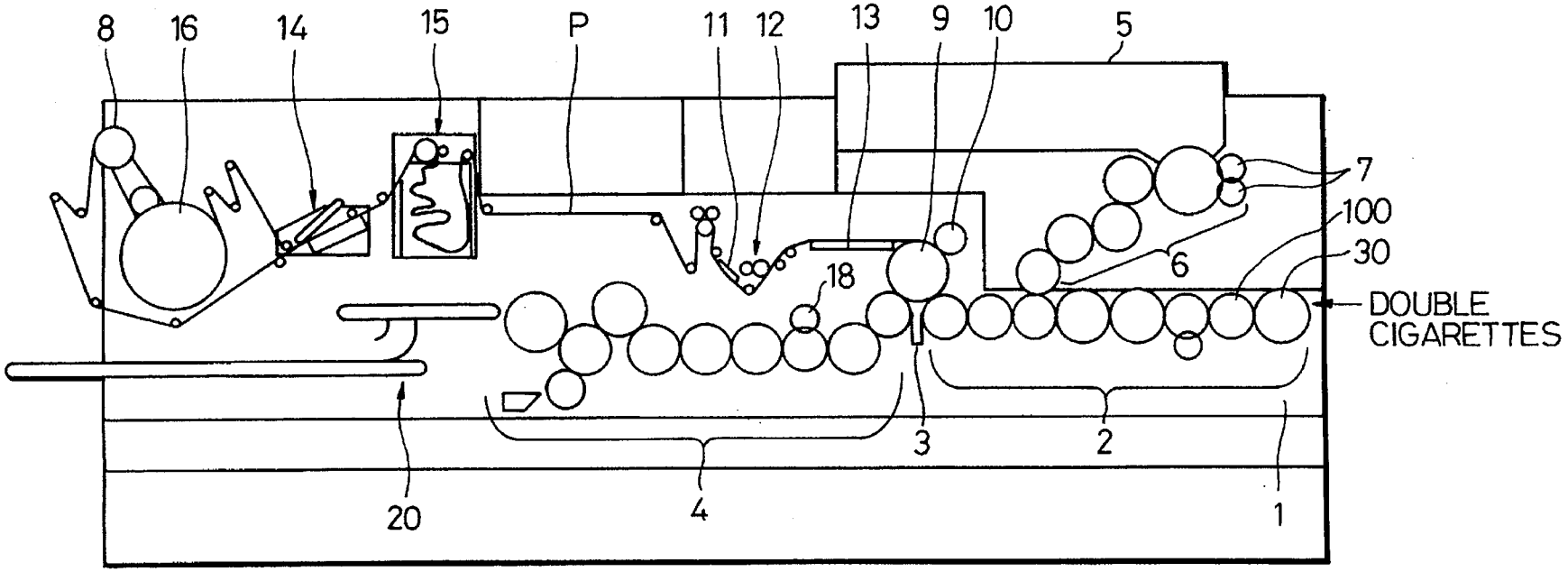
FIG. 1 is a schematic view showing an example of a filter attachment.

Referring to FIG. 1, a filter attachment for attaching filters to cigarettes comprises a frame 1. A drum train 2 is mounted on the frame 1 and extends to the left from the right-hand end of the frame 1, as viewed in FIG. 1. The terminal end of the drum train 2 is connected to a rolling section 3.

The drum train 2 includes a large number of grooved drums which are arranged in line adjacent to each other. A large number of transport grooves are formed in the outer peripheral surface of each grooved drum at regular intervals in the circumferential direction thereof.

When double cigarettes formed by a cigarette manufacturing machine (not shown) reach the drum train 2, that is, a grooved drum 30 located at the starting end of the drum train 2, they are received in corresponding ones of the transport grooves of the drum 30. The double cigarette has a length twice that of a cigarette used in each filter cigarette. As the grooved drum 30 rotates, the double cigarettes on the drum 30 are transported toward a grooved drum adjacent thereto, and are received in corresponding ones of the transport grooves of this grooved drum. The double cigarettes are thereafter successively transferred to each adjacent grooved drum in a similar manner, and thus are transported toward the rolling section 3.

One grooved drum in the drum train 2 is provided with a rotary knife 4, which cuts each of the double cigarettes transported onto this grooved drum into a pair of single cigarettes of equal length. In the subsequent transportation process, each pair of single cigarettes are separated from each other to provide a predetermined space therebetween.

Figure 2:
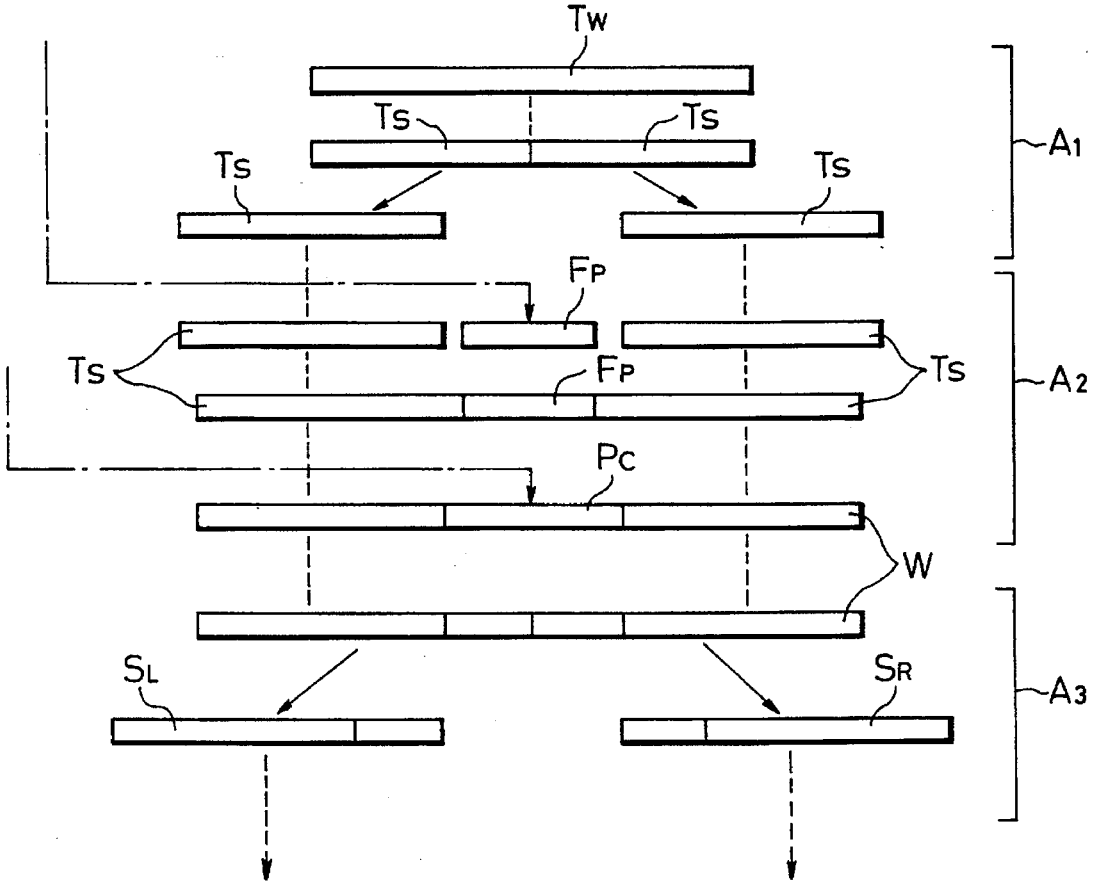
FIG. 2 is a diagram showing the flow of double cigarettes and single cigarettes in the filter attachment of FIG. 1.

In FIG. 2, the above-described cutting and separation process for double cigarettes is indicated in part $A_1$, wherein symbols $T_W$ and $T_S$ represent the double cigarette and the single cigarette, respectively.

A hopper 5 is arranged above the drum train 2 and stores a large number of filter rods therein. The hopper 5 and the drum train 2 are connected to each other by a drum train 6. Like the drum train 2, the drum train 6 includes a large number of grooved drums. The drum train 6 receives the filter rods, one by one, from the hopper 5 and transports them toward the drum train 2. In this process of transportation of the filter rods, each filter rod is cut into a plurality of equal parts by a plurality of rotary knives 7, thus obtaining a plurality of filter plugs from one filter rod. Then, the filter plugs are arranged in line in the transportation direction and are successively fed onto the drum train 2 such that each filter plug is situated between a pair of single cigarettes. Each filter rod may be cut into two parts by a rotary knife.

Each pair of single cigarettes and a filter plug therebetween, which are coaxially arranged on the drum train 2, are moved such that the pair of single cigarettes are in close contact with the respective opposite ends of the filter plug.

The rolling section 3 is successively supplied with pairs of single cigarettes with the filter plugs therebetween, which have been aligned as described above, and at the same time with pieces of tip paper. One side of each tip paper piece is already applied with paste. Each pair of single cigarettes and the filter plug associated therewith are caused to roll on the rolling section 3, whereby the tip paper piece is wound around the filter plug and the inner end portions of the single cigarettes which are in close contact with the opposite ends of the filter plug. Thus, the filter plug and the corresponding pair of single cigarettes are connected together. At this stage, a double filter cigarette W corresponding to two filter cigarettes is obtained.

In FIG. 2, the process of supplying filter plugs and winding tip paper pieces is indicated in part $A_2$, wherein symbols $F_P$ and $P_C$ represent the filter plug and the tip paper piece, respectively.

The supply of tip paper pieces will be explained. As shown in FIG. 1, paper rolls 8 and 16 are arranged at the left-hand end portion of the frame 1. In the state shown in FIG. 1, tip paper P is delivered from the paper roll 8. The tip paper P thus delivered is guided to a receiving drum 9, which is a suction drum located right above the rolling section 3. The tip paper P fed onto the receiving drum 9 is cut into individual tip paper pieces by a rotating edged drum 10.

Along the feed path for the tip paper P from the paper roll 8 to the receiving drum 9, a switching device 14 for switching rolls from which the tip paper P is delivered, a reservoir 15 for the tip paper P, a preheater 11, a device 12 for applying paste to one side of the tip paper P, and a postheater 13 are arranged in succession from the side of the paper roll 8.

A drum train 17 similar to the drum train 2 extends to the left from the rolling section 3. This drum train 17 receives the double filter cigarettes W from the rolling section 3 and transports them to a conveyor 20. In this transportation process, each double filter cigarette W is cut in the center of the filter plug by a rotary knife 18, thus obtaining individual filter cigarettes. Then, a predetermined space is provided between right and left filter cigarettes.

In FIG. 2, the process of cutting double filter cigarettes W and separating right and left filter cigarettes is indicated in part $A_3$, wherein symbols $S_L$ and $S_R$ represent the left and right filter cigarettes, respectively.

The filter cigarettes $S_L$ and $S_R$ fed onto the conveyor 20 from the drum train 17 are then supplied to a packaging machine, not shown, by the conveyor 20.

Figure 3:
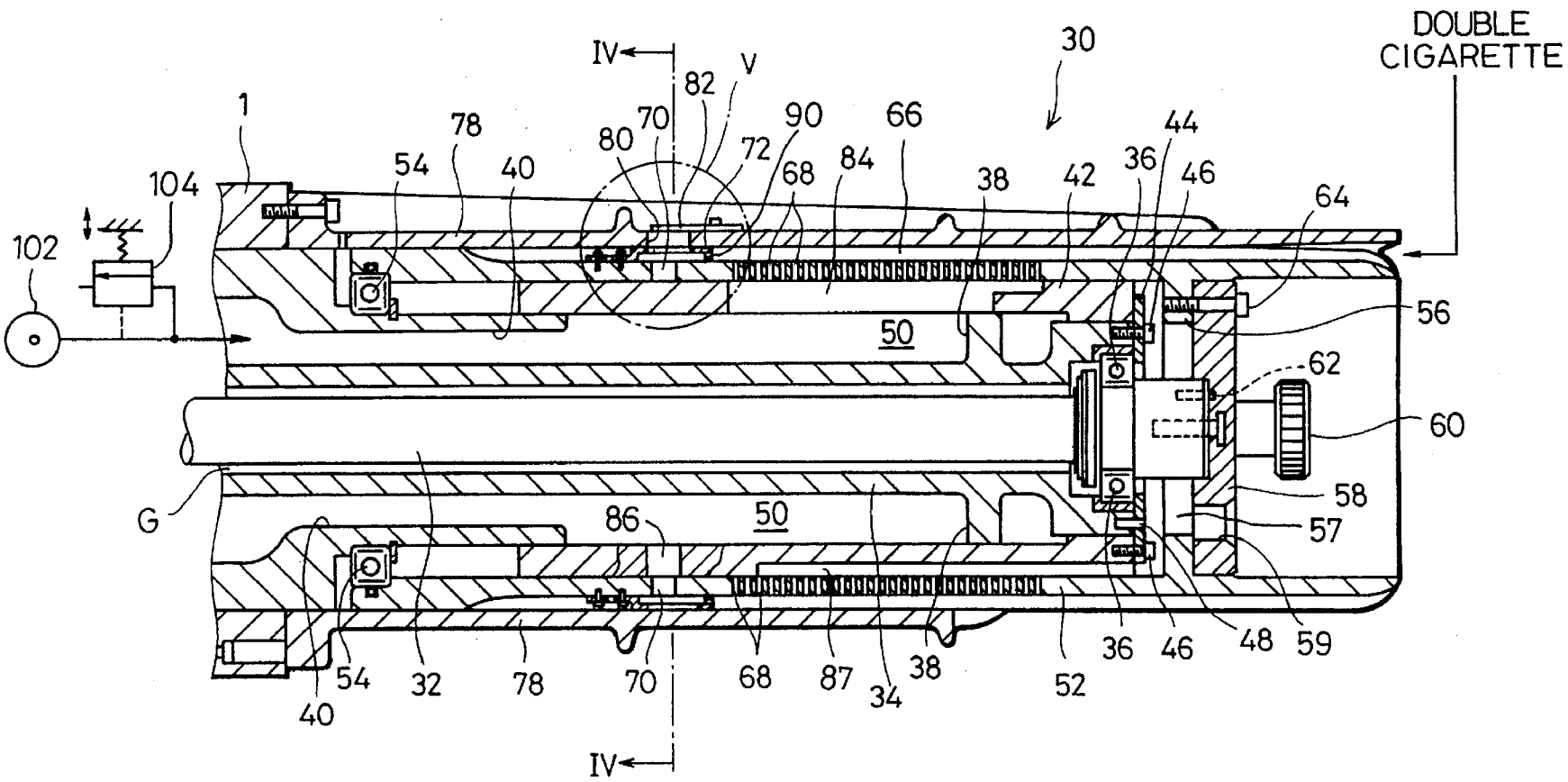
FIG. 3 is a longitudinal sectional view of a catcher drum in the filter attachment of FIG. 1.

Referring now to FIG. 3, there is shown in detail the aforementioned grooved drum 30 in the drum train 2, that is, the catcher drum.

The catcher drum 30 has a drum shaft 32 in the center thereof, the drum shaft 32 extending horizontally. The drum shaft 32 is surrounded by a fixed sleeve 34 and is rotatably supported on the sleeve 34 by means of a pair of bearings 36. FIG. 3 shows only one bearing 36 arranged at one end of the fixed sleeve 34, and the other bearing is not shown. An annular gap G is defined between the drum shaft 32 and the fixed sleeve 34. The other end of the fixed sleeve 34 is securely fitted in the frame 1.

The drum shaft 32 projects from the other end of the fixed sleeve 34 into the interior of the frame 1, though not shown, and this projecting end portion is fitted with a plurality of gears constituting part of a power transmission system. Thus, when power is transmitted from the power transmission system, the drum shaft 32 rotates in one direction.

A plurality of openings 38 are formed in the outer peripheral surface of the fixed sleeve 34. The openings 38 extend in the circumferential direction of the fixed sleeve 34 but are separated from each other in the circumferential direction of the same.

A control sleeve 42 is fitted around the fixed sleeve 34 and defines the openings 38 so as to form suction chambers 50. The control sleeve 42 is fixed to the fixed sleeve 34. More specifically, a connecting ring 44 is affixed to one end face of the fixed sleeve 34 and the corresponding end face of the control sleeve 42, and is connected to the sleeves 34 and 42 by means of a plurality of connecting bolts 46. Further, the connecting ring 44 has an index pin 48, and an index hole is formed in the end face of the control sleeve 42. Thus, the fixed sleeve 34 and the control sleeve 42 are connected to each other with the index pin 48 inserted into the index hole of the control sleeve 42, whereby the mounting angle of the control sleeve 42 relative to the fixed sleeve 34 can be accurately set.

A plurality of passages 40 are formed in the fixed sleeve 34 and extend along the axis thereof. Each passage 40 has one end connected to a suction passage (not shown) in the frame 1 and the other end connected to the corresponding opening 38, that is, the corresponding suction chamber 50.

As shown in FIG. 3, the suction passage is connected to a negative pressure source 102 such as a blower. The negative pressure source 102 discharges the air in the suction chambers 50 through the passages 40 and supplies a suction pressure to the suction chambers 50.

Further, a pressure regulating valve 104 is connected to the suction passage extending between the negative pressure source 102 and the passages 40, and controls the suction pressure to be supplied to the suction chambers 50.

A drum shell 52 is fitted around the outer peripheral surface of the control sleeve 42 so as to be slidable on the sleeve 42 in an airtight manner. The drum shell 52 has one end projecting beyond the one end of the fixed sleeve 34 and the other end rotatably supported on the outer peripheral surface of the fixed sleeve 34 by means of a bearing 54.

The drum shell 52 is coupled to the drum shaft 32 for rotation together therewith. The connection between the drum shell 52 and the drum shaft 32 will be explained in more detail. One end of the drum shaft 32 extends beyond the one end of the fixed sleeve 34, and an inner flange 56 is formed on the inner peripheral surface of the drum shell 52. The inner flange 56 projects inward from the drum shell 52.

A drive disk 58 is connected to the one end of the drum shaft 32 by means of a connecting knob 60, and the outer peripheral edge of the disk 58 is connected to the inner flange 56 of the drum shell 52 by means of a plurality of connecting screws 64. Inside the drum shell 52, a chamber 57 is defined between the drive disk 58 and the control sleeve 42.

The drive disk 58 is provided with an index pin 62, and an index hole is formed in the one end face of the drum shaft 32. The drum shell 52 is coupled to the drum shaft 32 with the index pin 62 inserted into the index hole, whereby the rotational phase or the mounting angle of the drum shell 52 relative to the drum shaft 32 can be set accurately.

An atmosphere hole 59 is formed through the drive disk 58 to allow the atmosphere to be always introduced into the chamber 57.

Figure 4:
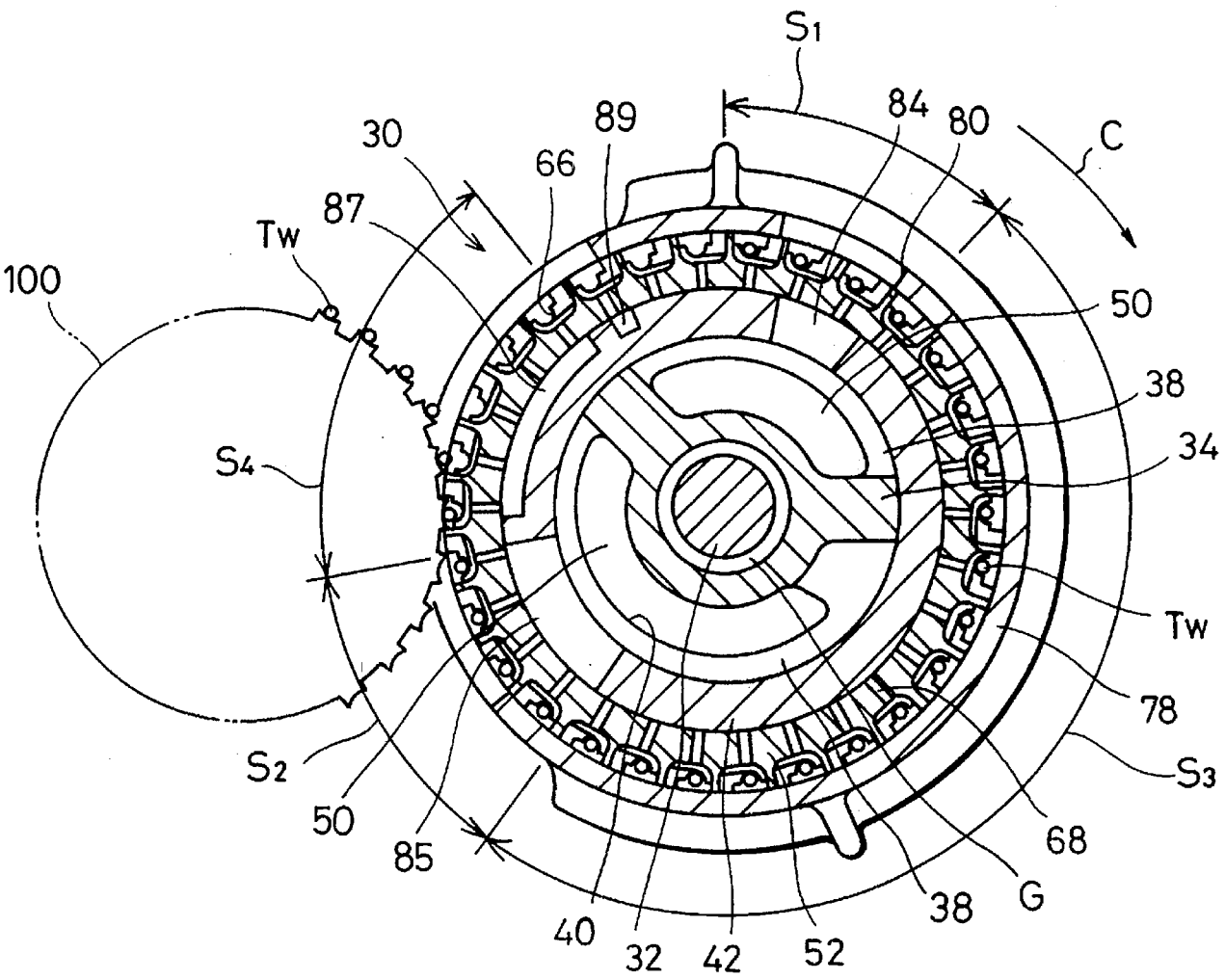
FIG. 4 is a sectional view taken along line IV—IV in FIG. 3.

As clearly shown in FIG. 4, a large number of receiving grooves 66 are formed in the outer peripheral surface of the drum shell 52. The receiving grooves 66 are arranged at regular intervals in the circumferential direction of the drum shell 52 and each open at one end of the drum shell 52.

The double cigarettes $T_W$ produced by the cigarette manufacturing machine are successively delivered therefrom toward the outer peripheral edge of the catcher drum 30, and in this case, the delivery line for the double cigarettes $T_W$ is in alignment with the axis of each double cigarette $T_W$ and parallel with the axis of the catcher drum 30. When each double cigarette $T_W$ thereafter reaches a position close to the catcher drum 30, it is accelerated on the delivery line and thus is separated from the subsequent double cigarette $T_W$. Accordingly, the catcher drum 30 is intermittently supplied with the double cigarettes $T_W$. The accelerated double cigarette $T_W$ is then given a kinetic component in a direction intersecting the delivery line, that is, in the rotating direction of the catcher drum 30. Consequently, during rotation of the catcher drum 30, each receiving groove 66 of the drum shell 52 can reliably receive a double cigarette $T_W$ therein by causing the leading end of the double cigarette $T_W$ to enter the open end of the receiving groove 66 at the same time that the receiving groove 66 is positioned in alignment with the extension from the delivery line of the double cigarette $T_W$.

Each receiving groove 66 has a depth greater than the diameter of the double cigarette $T_W$; therefore, the double cigarette $T_W$ received in the receiving groove 66 does not project from the outer peripheral surface of the drum shell 52.

As clearly shown in FIG. 3, a large number of first suction holes 68 are formed in a region of the bottom of each receiving groove 66. Each of the first suction holes 68 radially extends through the drum shell 52 and opens in the inner peripheral surface of the shell 52. Also, a single second suction hole 70 is formed in the bottom of each receiving groove 66 at a distance from the region in which the first suction holes 68 are formed, that is, at a location ahead of the region of the first suction holes 68 with respect to the direction of entry of the double cigarette $T_W$. The second suction hole 70 also extends radially through the drum shell 52 and opens in the inner peripheral surface of the shell 52. This second suction hole 70 is in the form of a slot extending in the axial direction of the receiving groove 66 and has a greater opening area than that of each of the first suction holes 68.

The control sleeve 42 has suction slots 84 and 85 formed therein. The suction slots 84 and 85 are located so as to be connectable with the first suction holes 68 of the receiving grooves 66, and are separated from each other in the circumferential direction of the control sleeve 42. Specifically, as is clear from FIG. 4, the suction slot 84 extends for a region $S_1$ in the circumferential direction of the control sleeve 42, and the suction slot 85 extends for a region $S_2$ in the circumferential direction of the sleeve 42. The suction slots 84 and 85 are always connected to the corresponding suction chambers 50.

Further, the control sleeve 42 has another suction slot 86 formed therein (see FIG. 3). This suction slot 86 is located so as to be connectable with the second suction holes 70 of the receiving grooves 66, and extends for a region $S_3$ between the regions $S_1$ and $S_2$ in the circumferential direction of the control sleeve 42. The suction slot 86 is always connected to the suction chambers 50.

Atmosphere grooves 87 and 89 are formed in the outer peripheral surface of the control sleeve 42. As shown in FIG. 4, the atmosphere groove 87 extends from the circumscription point between the catcher drum 30 and a grooved drum 100 adjoining the drum 30, for a predetermined distance in the rotating direction of the catcher drum 30, that is, in the direction indicated by arrow C in FIG. 4 (cf. region $S_4$ in FIG. 4). The atmosphere groove 87 also extends in the axial direction of the control sleeve 42 and opens at one end of the control sleeve 42, as clearly shown in FIG. 3. Accordingly, the atmosphere groove 87 is always in communication with the atmosphere through the chamber 57 and the atmosphere hole 59 of the drive disk 58.

On the other hand, the atmosphere groove 89 is situated ahead of the atmosphere groove 87 in the rotating direction C of the drum shell 52, and extends from a position where it can be connected to the second suction hole 70, to the one end of the control sleeve 42. Thus, like the atmosphere groove 87, the atmosphere groove 89 also is always in communication with the chamber 57, that is, the atmosphere.

During rotation of the drum shell 52, when the first suction holes 68 of one receiving groove 66 are connected to the suction slot 84 or 85 of the control sleeve 42, they are supplied with the suction pressure from the corresponding suction chamber 50. Similarly, when the second suction hole 70 of a receiving groove 66 is connected to the suction slot 86 of the control sleeve 42, it is supplied with the suction pressure from the suction chambers 50.

On the other hand, when the first and second suction holes 68 and 70 are connected respectively to the atmosphere grooves 87 and 89 of the control sleeve 42, they are connected to the atmosphere through the respective atmosphere grooves.

Referring again to FIG. 3, the drum shell 52 has a stopper member 72 arranged in each receiving groove 66 thereof. Each stopper member 72 is arranged in the corresponding receiving groove 66 at a location so as to cover the open end of the second suction hole 70.

Figure 5:
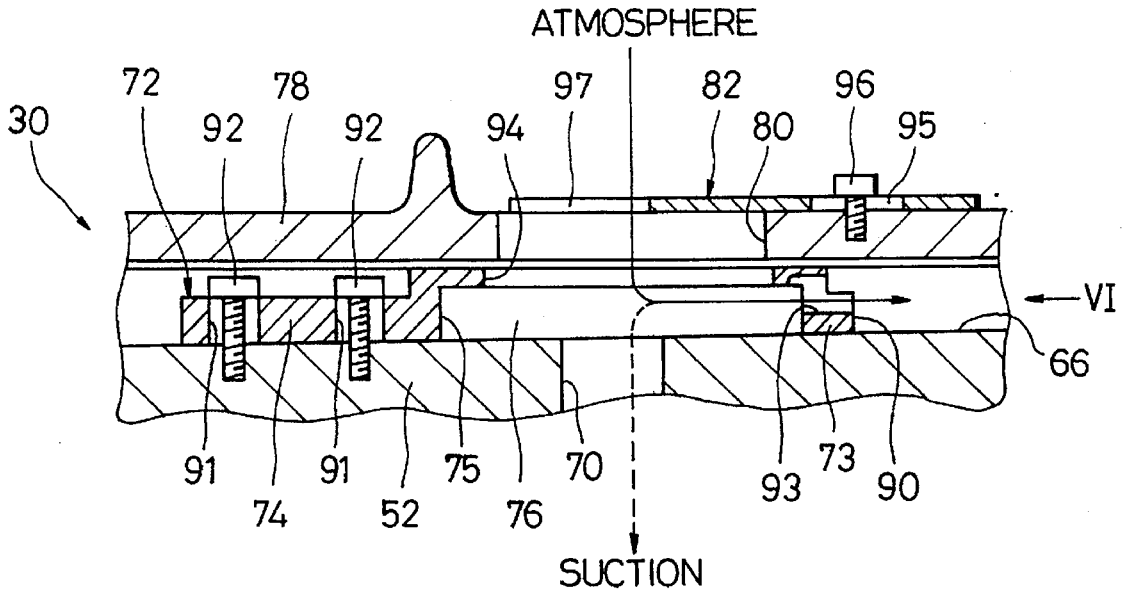
FIG. 5 is an enlarged view of a part indicated by V in FIG. 3.
Figure 6:
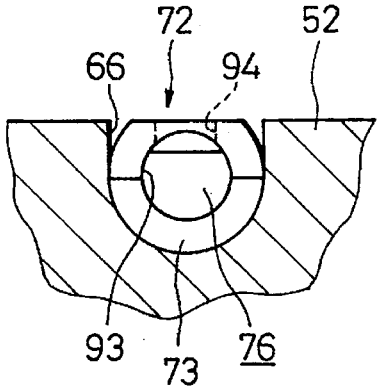
FIG. 6 is a view from a direction indicated by VI in FIG. 5.

FIGS. 5 and 6 show details of the stopper member 72. The stopper member 72 is in the form of a cylindrical member extending along the receiving groove 66, and a stepped flat surface is formed in part of the outer peripheral surface thereof. The flat surface extends from one end to the other of the stopper member 72. The stopper member 72 is fitted in the receiving groove 66 with the stepped flat surface thereof directed upward.

The central part of the flat surface in the axial direction of the stopper member 72 is greater in height than the other portions, and one end portion of the stopper member 72, that is, the end portion 73 closer to the first suction holes 68, has a stopper surface 90 facing the first suction holes 68. The stopper surface 90 of the stopper member 72 is located in the vicinity of the region in which the first suction holes 68 are formed, and the region of the first suction holes 68 has a length sufficiently greater than that of the double cigarette $T_W$.

The other end portion of the stopper member 72 is formed as a mounting portion 74 at which the member 72 is attached to the receiving groove 66, and the mounting portion 74 is longer in the axial direction than the end portion 73. Two through holes 91 are formed in the mounting portion 74 and are separated from each other in the axial direction of the stopper member 72. A bolt 92 is inserted through each through hole 91 and screwed into the bottom of the receiving groove 66. Thus, the stopper member 72 is fixed in the corresponding receiving groove 66 by means of the bolts 92. However, since each of the through holes 91 is an elongate hole extending in the axial direction of the receiving groove 66, as clearly shown in FIG. 5, the mounting position of the stopper member 72, that is, the position of the stopper surface 90, is adjustable.

A cut-out 75 is formed in the outer peripheral surface of the stopper member 72. The cut-out 75 is separated from the aforementioned central part of the flat surface in the diametrical direction of the stopper member 72, and a space 76 is defined by the inner surfaces of the cut-out 75 and receiving groove 66. A circular hole 93 extends from the space 76 and opens into a stepped surface between the central part of the flat surface and the one end portion 73, as well as into the stopper surface 90. The stopper member 72 further has an opening 94 formed in the central flat surface thereof and communicating with the space 76. When the suction pressure is supplied to the second suction hole 70 (cf. dashed arrow in FIG. 5), the suction pressure prevails in the portion of the receiving groove 66 on the same side as the first suction holes 68 through the space 76 and the hole 93.

As shown in FIG. 4, a drum cover 78 surrounds the outer peripheral surface of the drum shell 52 except for the region facing the aforementioned grooved drum 100. The drum cover 78 extends in the axial direction of the drum shell 52 and has one end fixed to the frame 1, as clearly shown in FIG. 3. Thus, the drum cover 78 serves to make each receiving groove 66 of the drum shell 52 tunnel-shaped. The other end of the drum cover 78 is situated at the one end of the drum shell 52, and defines inlets of the tunnels in cooperation with the open ends of the corresponding receiving grooves 66.

A rectangular atmosphere hole 80 is formed in the drum cover 78 and extends in the axial direction of the cover 78. The atmosphere hole 80 is located, with respect to the axial direction of the receiving groove 66, such that it is connectable with the opening 94 of the stopper member 72. With respect to the rotating direction of the drum shell 52, the atmosphere hole 80 is located at an angular position of the drum shell 52 where the double cigarette $T_W$ is to be received, or more specifically, at a position (region $S_1$) corresponding to the suction slot 84 of the control sleeve 42, as clearly shown in FIG. 4.

When each receiving groove 66 passes right under the atmosphere hole 80 with rotation of the drum shell 52, the opening 94 of the stopper member 72 of this receiving groove 66 is connected to the atmosphere hole 80. At this time, therefore, the atmospheric pressure is introduced into the space 76 of the stopper member 72 through the atmosphere holes 80 and 94, and then is supplied from the space 76 to the first suction hole (68)-side portion of the receiving groove 66 through the hole 93 (cf. solid-line arrow in FIG. 5).

Further, a slider 82 for covering the atmosphere hole 80 is provided on the drum cover 78 and has a pair of slits 95 formed in one end portion thereof. A bolt 96 is inserted through each slit 95 and screwed into the drum cover 78. Thus, the slider 82 is slidable on the drum cover 78 in the direction indicated by arrow D in FIG. 7, and the opening area of the atmosphere hole 80 can be adjusted by sliding the slider 82.

Figure 7:
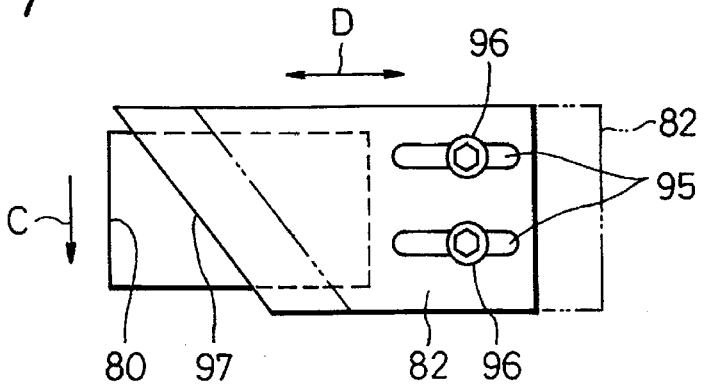
FIG. 7 is a plan view of a slider for adjusting the opening area of an atmosphere hole formed in a drum cover.

As clearly shown in FIG. 7, the other end of the slider 82 is formed as a slanting edge 97. More specifically, the slanting edge 97 is inclined in such a direction that the opening area of the atmosphere hole 80 increases in the rotating direction C of the drum shell 52.

Referring now to FIGS. 8 through 12, the operation of the catcher drum 30 will be explained. In FIGS. 8–12, the double cigarette $T_W$ is crosshatched for ease of distinction.

Figure 8:
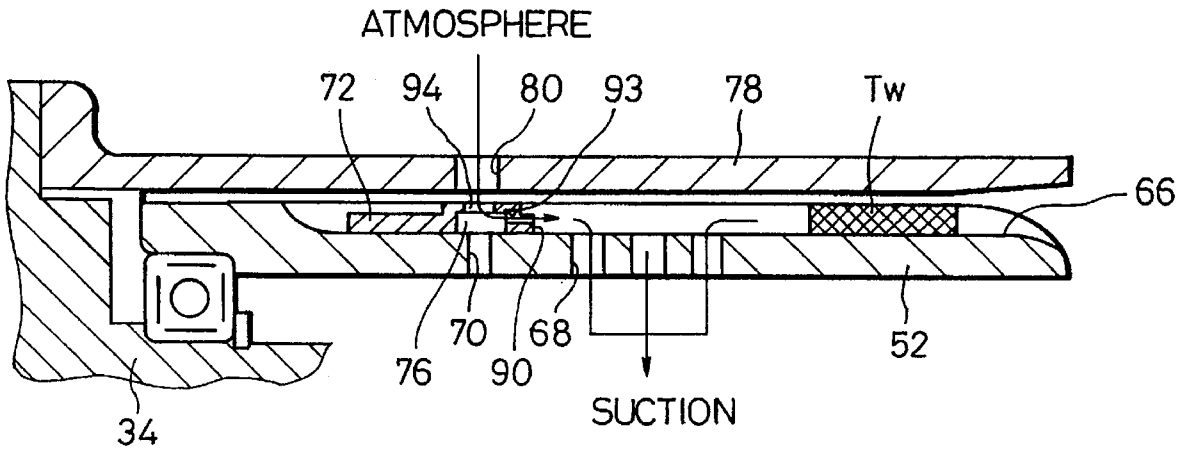
FIG. 8 is a view showing a state immediately after a double cigarette enters a receiving groove of the catcher drum.

During rotation of the drum shell 52, when a tunnel-shaped receiving groove 66 of the drum shell 52 reaches the aforementioned receiving position, a double cigarette $T_W$ enters this receiving groove 66 from the inlet thereof and advances within the groove 66, as shown in FIG. 8.

At this time, the first suction holes 68 of this receiving groove 66 are connected to the suction chamber 50 through the suction slot 84 of the control sleeve 42. The opening 94 of the stopper member 72 of the receiving groove 66, on the other hand, is connected to the atmosphere hole 80 of the drum cover 78, whereby the atmospheric pressure is introduced into the space 76 of the stopper member 72. Accordingly, when the receiving groove 66 receives the double cigarette $T_W$ therein, the groove 66 is supplied with the suction pressure through the first suction holes 68 and at the same time with the atmospheric pressure from the space 76 of the stopper member 72 through the hole 93.

Figure 9:
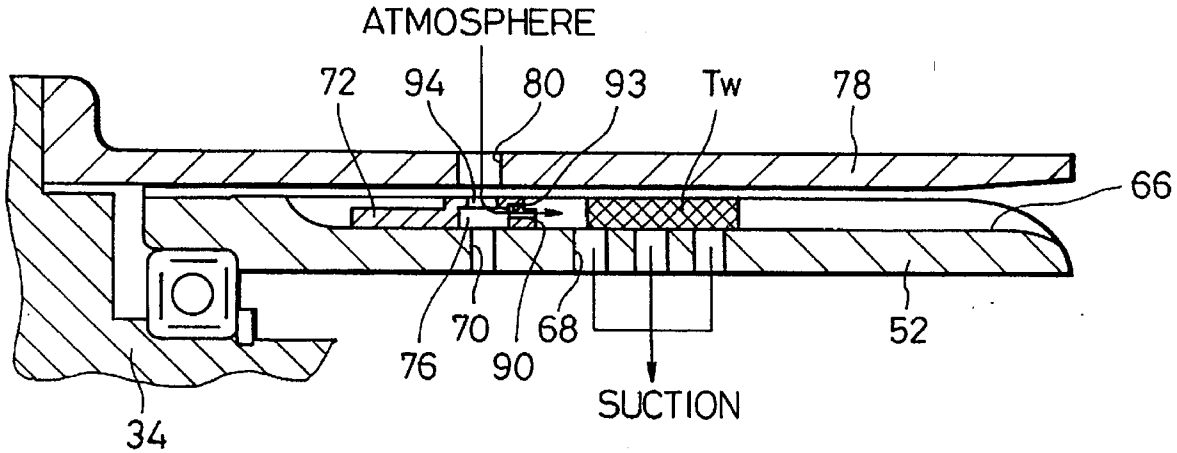
FIG. 9 is a view showing a state in which the double cigarette in the receiving groove is temporarily stopped at a position short of a stopper member of the receiving groove.

The suction pressure applied via the open ends of the first suction holes 68 and the atmospheric pressure introduced from the hole 93 of the stopper member 72 give a braking force and air resistance to the double cigarette $T_W$ advancing within the receiving groove 66. Consequently, the double cigarette $T_W$ advancing within the receiving groove 66 is decelerated by the braking force and air resistance, and is stopped at a position short of the stopper member 72, as shown in FIG. 9.

When the receiving groove 66 which has received the double cigarette $T_W$ thereafter passes through the region $S_3$ in FIG. 4 with further rotation of the drum shell 52, the first suction holes 68 of this receiving groove 66 are disconnected from the suction slot 84, and thus the supply of the suction pressure to the first suction holes 68 stops. Also, the opening 94 of the stopper member 72 of the receiving groove 66 is disconnected from the atmosphere hole 80 of the drum cover 78; therefore, the introduction of the atmosphere to the opening 94, that is, to the space 76 of the stopper member 72, stops.

Figure 10:
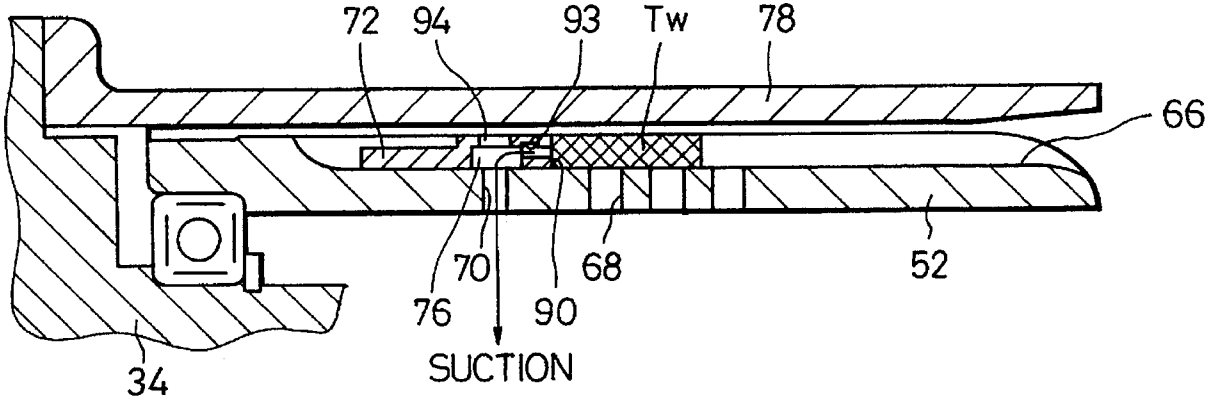
FIG. 10 is a view showing a state in which the double cigarette is in close contact with the stopper member and thus is positioned.

In the process of travel of the receiving groove 66 in the region $S_3$, when the second suction hole 70 is connected to the suction slot 86 of the control sleeve 42, the suction pressure is introduced into the space 76 of the stopper member 72 and then prevails in the receiving groove 66 via the hole 93 of the stopper member 72. The suction pressure introduced into the receiving groove 66 attracts the double cigarette $T_W$, which is then stopped, toward the stopper member 72. As a result, the double cigarette $T_W$ again moves toward the stopper member 72 and is abutted against and held to the stopper surface 90 of the stopper member 72, as shown in FIG. 10.

The speed at which the double cigarette $T_W$ is moved from the stopped position toward the stopper member 72 due to the above-described suction effect is significantly smaller than that at which the double cigarette $T_W$ enters the receiving groove 66. Accordingly, the double cigarette $T_W$ never violently collides against the stopper surface 90 of the stopper member 72, whereby the double cigarette $T_W$ is prevented from rising from the receiving groove 66 and also damage to the end of the double cigarette $T_W$ is prevented. The end of the double cigarette $T_W$ can be damaged if the wrapping paper wrinkles, if shredded tobacco drops off the cigarette end, or if the cigarette end is caught in the stopper surface 90.

Figure 11:
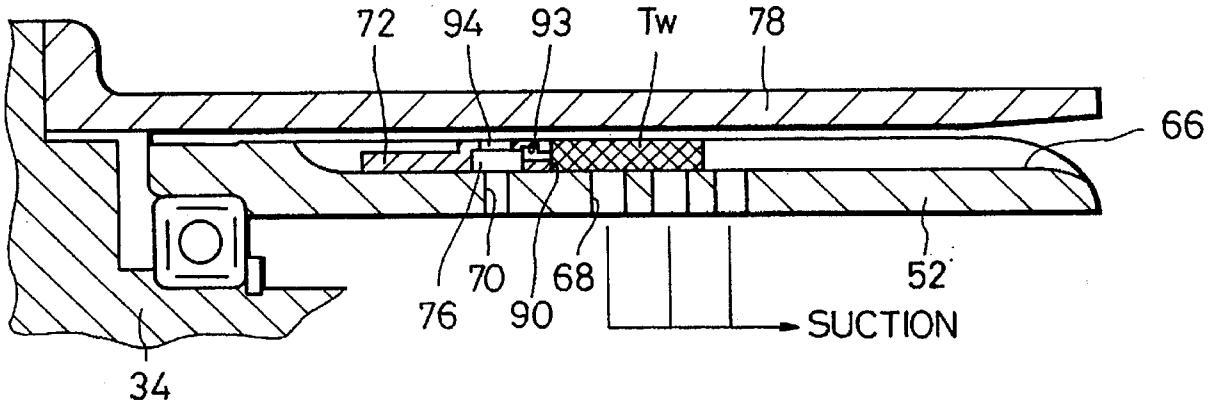
FIG. 11 is a view showing a state in which a suction force is again acted upon the double cigarette positioned as shown in FIG. 10.

When the receiving groove 66 having the double cigarette $T_W$ therein passes through the region $S_2$ in FIG. 4 with further rotation of the drum shell 52, the second suction hole 70 is disconnected from the suction slot 86, whereupon the stopper surface 90 of the stopper member 72 stops attracting the double cigarette $T_W$ by suction. However, since at this time the first suction holes 68 are connected to the suction slot 85, the double cigarette $T_W$ in the receiving groove 66 is subjected to the suction pressure from the first suction holes 68 and thus is reliably held in the groove 66, as shown in FIG. 11. Therefore, the double cigarette $T_W$ never becomes separated from the stopper surface 90 of the stopper member 72.

Figure 12:
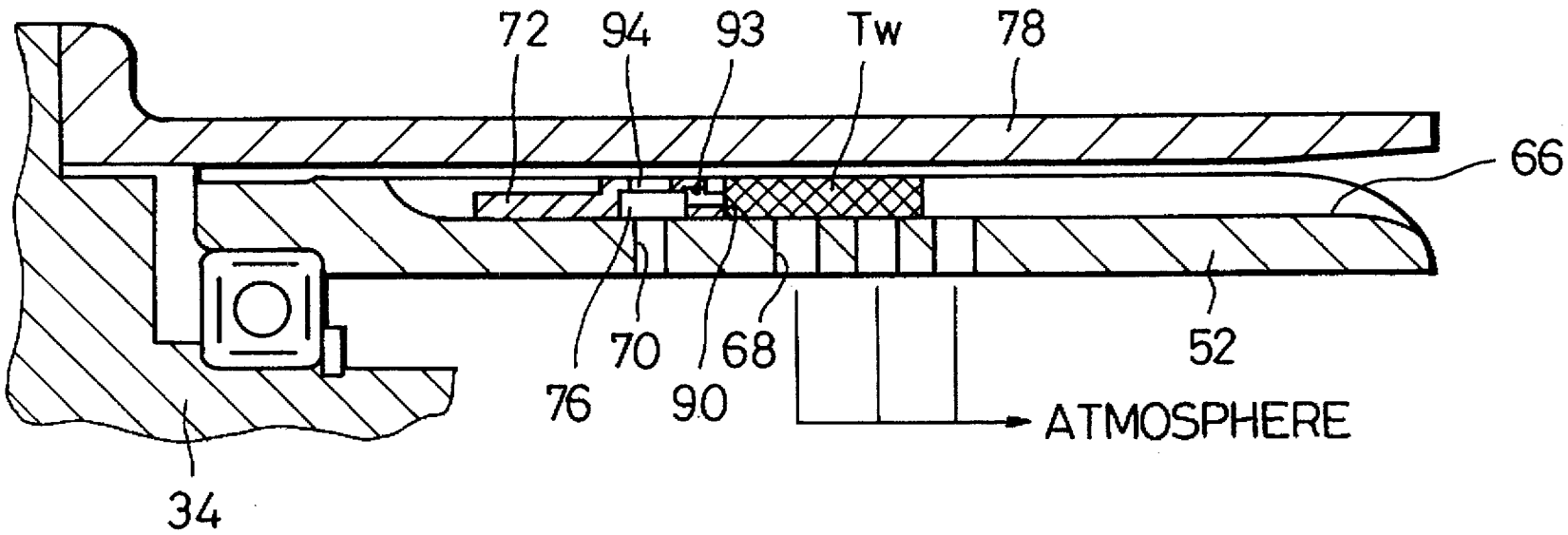
FIG. 12 is a view showing a state in which the double cigarette in FIG. 11 is released from the suction force.

With further rotation of the drum shell 52, when the first suction holes 68 of the receiving groove 66 become connected to the atmosphere groove 87 of the control sleeve 42, that is, to the atmosphere, as shown in FIG. 12, or in other words, when the receiving groove 66 concerned approaches the outer peripheral surface of the adjacent grooved drum 100 (see FIG. 4), the double cigarette $T_W$ in the receiving groove 66 is released from the suctional holding at this point of time. Consequently, the double cigarette $T_W$ in the receiving groove 66 transfers from the drum shell 52, that is, the catcher drum 30, to a receiving groove of the grooved drum 100 under the suction pressure from the grooved drum 100.

The second suction hole 70 of the receiving groove 66 is thereafter connected to the atmosphere groove 89 of the control sleeve 42.

As mentioned above, the double cigarette $T_W$ is reliably received in the receiving groove 66 and the distal end thereof is positioned in close contact with the stopper surface 90 of the stopper member 72. Accordingly, the transfer of the double cigarette $T_W$ from the catcher drum 30 to the grooved drum 100 adjacent thereto can be performed with reliability.

In the case where, with increase in the operating speed of the cigarette manufacturing machine, the speed of delivery of double cigarettes $T_W$ from the cigarette manufacturing machine, that is, the speed of entry of double cigarettes $T_W$ to the receiving grooves 66 of the catcher drum 30, is increased, the suction pressure supplied to the suction chambers 50 of the catcher drum 30 is increased. The suction pressure can be increased by adjusting the relief pressure of the aforementioned pressure regulating valve 104.

In this case, since the suction pressure supplied from the suction chamber 50 to the first suction holes 68 increases, the braking force applied to the double cigarette $T_W$ in the receiving groove 66 also increases. Further, where the suction pressure from the first suction holes 68 is increased, the pressure of air flowing into the receiving groove 66 via the stopper member 72, that is, the air resistance to the advancing motion of the double cigarette $T_W$, also increases. Accordingly, even in the case where the operating speed of the cigarette manufacturing machine increases and thus the double cigarettes $T_W$ enter the receiving grooves 66 of the catcher drum 30 at a higher speed, each double cigarette $T_W$ can be reliably attracted to and held by the first suction holes 68 and be reliably stopped at a position short of the stopper member 72, without colliding against the stopper member 72.

Even though the speed of entry of the double cigarette $T_W$ to the receiving groove 66 is the same, the inertial mass of the double cigarette $T_W$ varies if the length or diameter of the double cigarette $T_W$, that is, the weight of the cigarette, changes. In such case, the aforementioned slider 82 is slid sideways to adjust the opening area of the atmosphere hole 80. This adjustment changes the flow rate of the atmosphere supplied to the receiving groove 66 via the stopper member 72, that is, the air resistance to the double cigarette $T_W$, whereby the double cigarette $T_W$ can be reliably stopped at a position short of the stopper surface 90 of the stopper member 72.

In connection with the opening area of the atmosphere hole 80, the edge of the slider 82 is formed as the slanting edge 97 (see FIG. 7). Accordingly, when the stopper member 72 of the receiving groove 66 passes right under the atmosphere hole 80, the overlapping area between the opening 94 of the stopper member 72 and the atmosphere hole 80 increases as the drum shell 52 rotates, that is, as the double cigarette $T_W$ in the receiving groove 66 approaches the stopper surface 90 of the stopper member 72. Therefore, since the air resistance to the double cigarette $T_W$ gradually increases, the double cigarette $T_W$ is stopped at a position short of the stopper surface 90 of the stopper member 72 without fail.

The adjustment of the opening area of the atmosphere hole 80 and the adjustment of the suction pressure to be supplied to the suction chambers 50 can be employed in combination.

In the foregoing embodiment, although the catcher drum 30 is used to receive double cigarettes, it can alternatively receive single cigarettes in the case where single cigarettes are delivered from the cigarette manufacturing machine.

What is claimed is:

1. An apparatus for receiving rod members intermittently delivered on a predetermined delivery line, comprising:

a catcher drum arranged at a terminal end of the delivery line and rotatable in one direction, said catcher drum including receiving grooves arranged on an outer peripheral surface thereof at regular intervals in a circumferential direction thereof, the receiving grooves each having a bottom extending parallel with the delivery line and one end opening in an end face of said catcher drum, the receiving grooves successively reaching a receiving position located in alignment with the delivery line as said catcher drum rotates, and a rod member at a leading position on the delivery line entering one of the receiving grooves from the one end thereof and advancing within the receiving groove;

covering means for said catcher drum, said covering means having a cover which covers part of the outer peripheral surface of said catcher drum along the circumferential direction of said catcher drum, the receiving position being contained in the cover, the cover making each of the receiving grooves tunnel-shaped when the receiving groove passes the cover as said catcher drum rotates;

a stopper member arranged in each of the receiving grooves;

braking means for stopping the rod member advancing in the tunnel-shaped receiving groove at a position short of said stopper member, said braking means including suction means for attracting the rod member to the bottom of the receiving groove;

assisting means for assisting a braking force exerted by the suction means on the rod member, said assisting means including introducing means for introducing atmospheric pressure into each said receiving groove, said introducing means including an atmosphere hole formed in the cover, and an atmosphere introducing channel including an aperture extending through said stopper member for connecting the atmosphere hole with the receiving groove; and actuating means for moving the rod member stopped in the tunnel-shaped receiving groove to said stopper member.

2. The apparatus according to claim 1, wherein said suction means includes a plurality of suction holes opening in the bottom surface of each receiving groove, and supply means for supplying a suction pressure to the suction holes after the rod member is received in the receiving groove, for a period of time in which the receiving groove passes through a predetermined first region with rotation of said catcher drum, and wherein said atmospheric pressure acts upon a leading end face of the rod member in an advancing direction thereof.

3. The apparatus according to claim 2, wherein said atmosphere hole is formed in the cover at a location corresponding to the first region, the atmosphere hole extending from the receiving position for a predetermined length in the circumferential direction of said catcher drum, said atmosphere introducing channel connecting the atmosphere hole with the receiving groove which has passed the receiving position as said catcher drum rotates.

4. The apparatus according to claim 2, wherein said supply means includes pressure regulating means for adjusting the suction pressure.

5. The apparatus according to claim 3, wherein said introducing means further includes adjusting means for adjusting the opening area of the atmosphere hole.

6. The apparatus according to claim 3, wherein said actuating means comprises second suction means for attracting the rod member stopped in the tunnel-shaped receiving groove toward said stopper member, the second suction means supplying a suction pressure to the tunnel-shaped receiving groove after the receiving groove passes the first region, for a period of time in which the receiving groove passes through a second region with rotation of said catcher drum.

7. The apparatus according to claim 6, wherein said second suction means includes a negative pressure introducing channel for introducing the suction pressure to the receiving groove, the negative pressure introducing channel and the atmosphere introducing channel sharing said aperture extending through said stopper member.

8. The apparatus according to claim 6, which further comprises second supply means for supplying a suction pressure to the suction holes after the tunnel-shaped receiving groove passes the second region with rotation of said catcher drum.

9. The apparatus according to claim 5, wherein said atmosphere hole has a rectangular shape extending in the axial direction of said catcher drum, and said adjusting means includes a slider mounted on an outer peripheral surface of the cover and covering part of the atmosphere hole, the slider being slidable in the axial direction of said catcher drum.

10. The apparatus according to claim 9, wherein said slider has a slanting edge at one end thereof for determining the opening area of the atmosphere hole, the slanting edge increasing the width of opening of the atmosphere hole in a rotating direction of said catcher drum.

11. An apparatus for receiving rod members intermittently delivered on a predetermined delivery line, comprising:

a catcher drum arranged at a terminal end of the delivery line and rotatable in one direction, said catcher drum including receiving grooves arranged on an outer peripheral surface thereof at regular intervals in a circumferential direction thereof, the receiving grooves each having a bottom extending parallel with the delivery line and one end opening in an end face of said catcher drum, the receiving grooves successively reaching a receiving position located in alignment with the delivery line as said catcher drum rotates, and a rod member at a leading position on the delivery line entering one of the receiving grooves from the one end thereof and advancing within the receiving groove;

covering means for said catcher drum, said covering means having a cover which covers part of the outer peripheral surface of said catcher drum along the circumferential direction of said catcher drum, the receiving position being contained in the cover, the cover making each of the receiving grooves tunnel-shaped when the receiving groove passes the cover as said catcher drum rotates;

a stopper member arranged in each of the receiving grooves;

braking means for stopping the rod member advancing in the tunnel-shaped receiving groove at a position short of said stopper member, said braking means including suction means for attracting the rod member to the bottom of the receiving groove;

assisting means for assisting a braking force exerted by the suction means on the rod member;

actuating means for moving the rod member stopped in the tunnel-shaped receiving groove to said stopper member;

said suction means including a plurality of suction holes opening in the bottom surface of each receiving groove, and supply means for supplying a suction pressure to the suction holes after the rod member is received in the receiving groove, for a period of time in which the receiving groove passes through a predetermined first region with rotation of said catcher drum;

said assisting means including introducing means for introducing atmospheric pressure into each said receiving groove, the introduced atmospheric pressure acting upon a leading end face of the rod member in an advancing direction thereof;

said introducing means including an atmosphere hole formed in the cover at a location corresponding to the first region, the atmosphere hole extending from the receiving position for a predetermined length in the circumferential direction of said catcher drum, and an atmosphere introducing channel for connecting the atmosphere hole and the receiving groove which has passed the receiving position as said catcher drum rotates;

said actuating means comprising second suction means for attracting the rod member stopped in the tunnel-shaped receiving groove toward said stopper member, the second suction means supplying a suction pressure to the tunnel-shaped receiving groove after the receiving groove passes the first region, for a period of time in which the receiving groove passes through a second region with rotation of said catcher drum; and said second suction means including a negative pressure introducing channel for introducing the suction pressure to the receiving groove, the negative pressure introducing channel and the atmosphere introducing channel sharing a common part extending through said stopper member.

12. The apparatus according to claim 11, wherein said supply means includes pressure regulating means for adjusting the suction pressure.

13. The apparatus according to claim 11, which further comprises second supply means for supplying a suction pressure to the suction holes after the tunnel-shaped receiving groove passes the second region with rotation of said catcher drum.

14. The apparatus according to claim 11, wherein said introducing means further includes adjusting means for adjusting the opening area of the atmosphere hole.

15. The apparatus according to claim 14, wherein said atmosphere hole has a rectangular shape extending in the axial direction of said catcher drum, and said adjusting means includes a slider mounted on an outer peripheral surface of the cover and covering part of the atmosphere hole, the slider being slidable in the axial direction of said catcher drum.

16. The apparatus according to claim 15, wherein said slider has a slanting edge at one end thereof for determining the opening area of the atmosphere hole, the slanting edge increasing the width of opening of the atmosphere hole in a rotating direction of said catcher drum.

17. The apparatus according to claim 1, wherein said actuating means comprises second suction means for attracting the rod member toward said stopper member, said second suction means including a negative pressure introduction channel for introducing suction pressure to the receiving groove through said aperture in said stopper member.

18. The apparatus according to claim 1, wherein said introducing means further includes adjusting means for adjusting the opening area of the atmosphere hole.

19. The apparatus according to claim 18, wherein said atmosphere hole in the cover is rectangular, and said adjusting means includes a slider mounted on said cover for covering at least a portion of said atmosphere hole, said slider being slidable in the axial direction of the catcher drum, said slider having a slanting edge at one end thereof oriented nonperpendicular to said axial direction.

20. The apparatus according to claim 1, further comprising a substantially cylindrical fixed sleeve defining a suction chamber therein, said sleeve having first slot means for allowing communication between said suction chamber and said receiving grooves over a first region of rotation of the catcher drum, second slot means for allowing communication between said suction chamber and said stopper members over a second region of rotation of the catcher drum, third slot means for allowing communication between said suction chamber and said receiving grooves over a third region of rotation of the catcher drum, and an atmosphere groove allowing communication between the atmosphere and said receiving grooves over a fourth region of rotation of the catcher drum.

* * * * *